US005846051A

United States Patent [19]

Massaro

[11] Patent Number: 5,846,051

[45] Date of Patent: Dec. 8, 1998

[54] SEALING DEVICE FOR DUST- AND LIQUID-ASPIRATING MACHINES

[75] Inventor: Vincenzo Massaro, Padua, Italy

[73] Assignee: Rotafil S.a.s. Di Vincenzo Massaro E C., Padua, Italy

[21] Appl. No.: 854,728

[22] Filed: May 12, 1997

[30] Foreign Application Priority Data

Jun. 12, 1996 [IT] Italy ..... PD96A0156

[51] Int. Cl.[6] ..... F04D 29/08

[52] U.S. Cl. ..... 415/170.1

[58] Field of Search ..... 415/170.1, 174.2, 415/174.3, 174.4, 229, 230

[56] References Cited

U.S. PATENT DOCUMENTS 2,993,711 7/1961 Pears ..... 415/174.2
5,026,253 6/1991 Borger ..... 415/229
5,275,530 1/1994 Kujawa et al. ..... 415/230

*Primary Examiner*—John T. Kwon
*Attorney, Agent, or Firm*—Guido Modiano; Albert Josif

[57] ABSTRACT

A sealing device for dust- and liquid-aspirating machines, comprising an electric motor provided with a shaft, to a cantilevered free end whereof an axial suction impeller is fixed, the impeller being contained in a casing wherein one or more delivery ducts are formed peripherally. The device further comprises an axially perforated disk-shaped element associated with the shaft, interposed between the motor and the casing, and having a perimetric surface shaped so as to form at least two successive tapering regions between which a change in diameter is interposed and forms a step, the configuration of the disk-shaped element being adapted to repel the liquid by centrifugal action and to dissipate its energy in association with the facing surface of a flanged sealing element having a hollow section that encapsulates part of the electric motor, and a flange connected to the casing upon assembly.

4 Claims, 2 Drawing Sheets

SEALING DEVICE FOR DUST- AND LIQUID-ASPIRATING MACHINES

BACKGROUND OF THE INVENTION

The present invention relates to a sealing device for dust- and liquid-aspirating machines.

Conventional dust- and liquid-aspirating machines substantially comprise an electric motor with a shaft on the free cantilevered end whereof the axial suction impeller is fixed, the impeller being contained in a casing wherein one or more delivery ducts are formed peripherally.

The ducts can be radial or tangential.

The main drawback affecting liquid-aspirating machines relates to fluid-tightness at the region where the driving shaft enters the casing inside which it supports the impeller.

Infiltration of liquids, affecting the electrical parts of the motor, is in fact particularly damaging in these machines.

This drawback is worsened in the presence of particularly aggressive liquids, which can lead to considerable damage to the machine as a whole.

SUMMARY OF THE INVENTION

A principal aim of the present invention is to provide a sealing device for dust- and liquid-aspirating machines which is adapted to substantially completely prevent fluids or particles from making contact with the electrical parts of the machine, particularly at the region where the shaft passes through the casing.

Within the scope of this aim, an object of the present invention is to provide a sealing device which does not hinder normal operation of the machine in any way.

Another object of the present invention is to provide a sealing device which does not further complicate the overall structure of the machine, allowing it to still have low costs with respect to conventional machines.

Another object of the present invention is to provide a sealing device which can be adapted to the various casings and impellers.

Another object of the present invention is to provide a sealing device which can be manufactured with conventional technologies and can optionally be adapted to already commercially available machines.

This aim, these objects, and others which will become apparent hereinafter are achieved by a sealing device for dust- and liquid-aspirating machines, which comprises an electric motor with a shaft to a cantilevered free end whereof an axial suction impeller is fixed, said impeller being contained in a casing wherein one or more delivery ducts are formed peripherally, said device being characterized in that it comprises an axially perforated disk-shaped element associated with said shaft, interposed between said motor and said casing, and provided with a perimetric surface which is shaped so as to form at least two successive tapering portions between which a change in diameter is interposed and forms a step, the configuration of said disk-shaped element being adapted to repel the liquid by centrifugal action and to dissipate its energy in association with the facing surface of a flanged sealing element having a hollow section that encapsulates part of said electric motor, and a flange connected to said casing upon assembly.

BRIEF DESCRIPTION OF THE DRAWINGS

Further characteristics and advantages of the present invention will become apparent from the following detailed description of an embodiment thereof, illustrated only by way of non-limitative example in the accompanying drawings, wherein.

DESCRIPTION OF THE PREFERRED EMBODIMENTS

Figure 1:
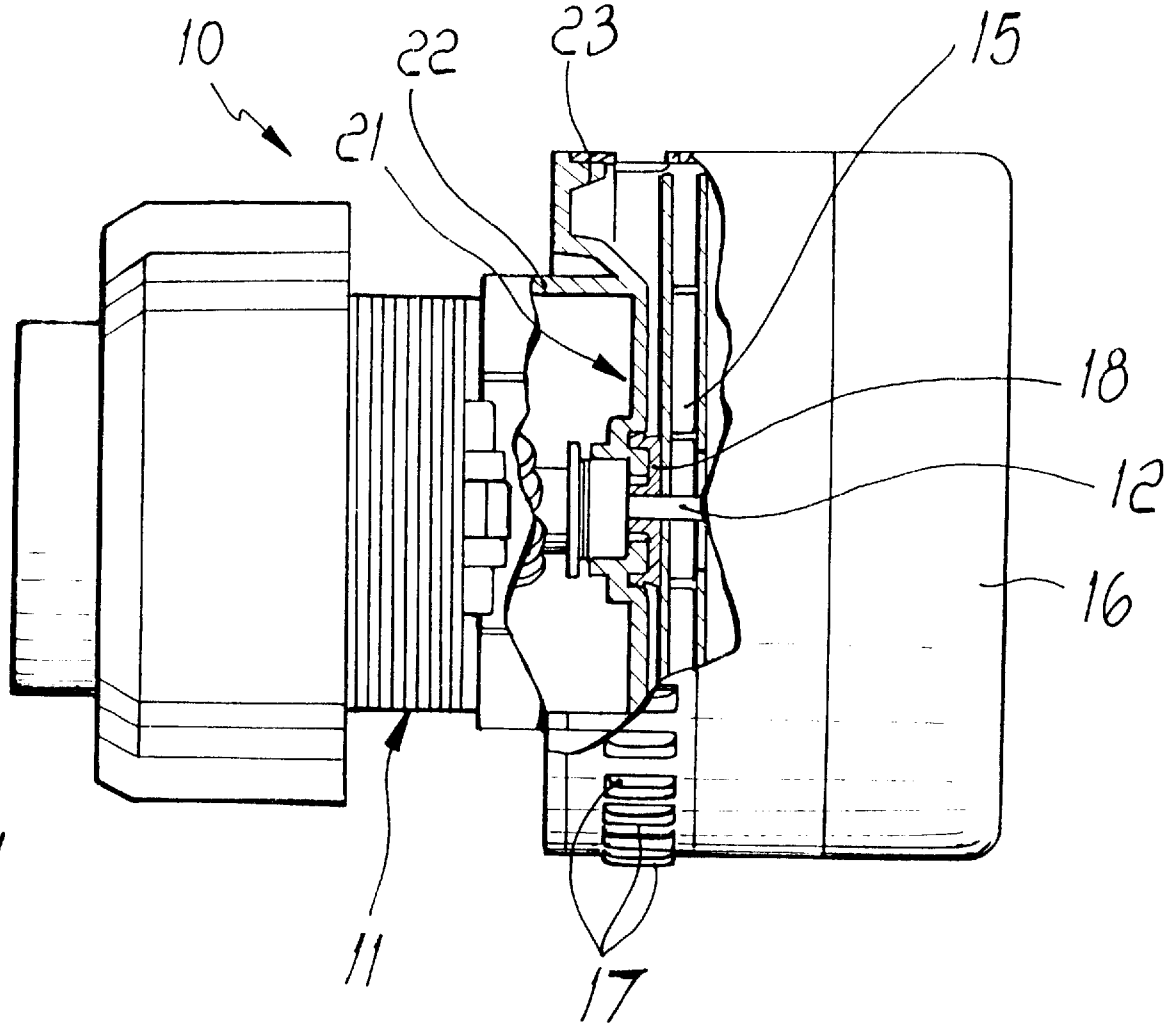
FIG. 1 is a partially sectional view of a dust- and liquid-aspirating machine provided with a sealing device according to the present invention.
Figure 3:
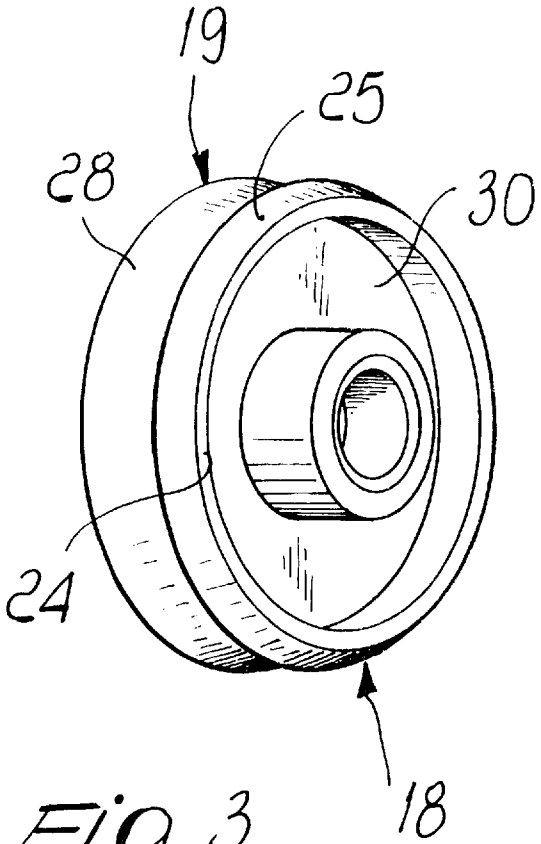
FIG. 3 is a perspective view of another detail of the machine of FIG. 1.
Figure 2:
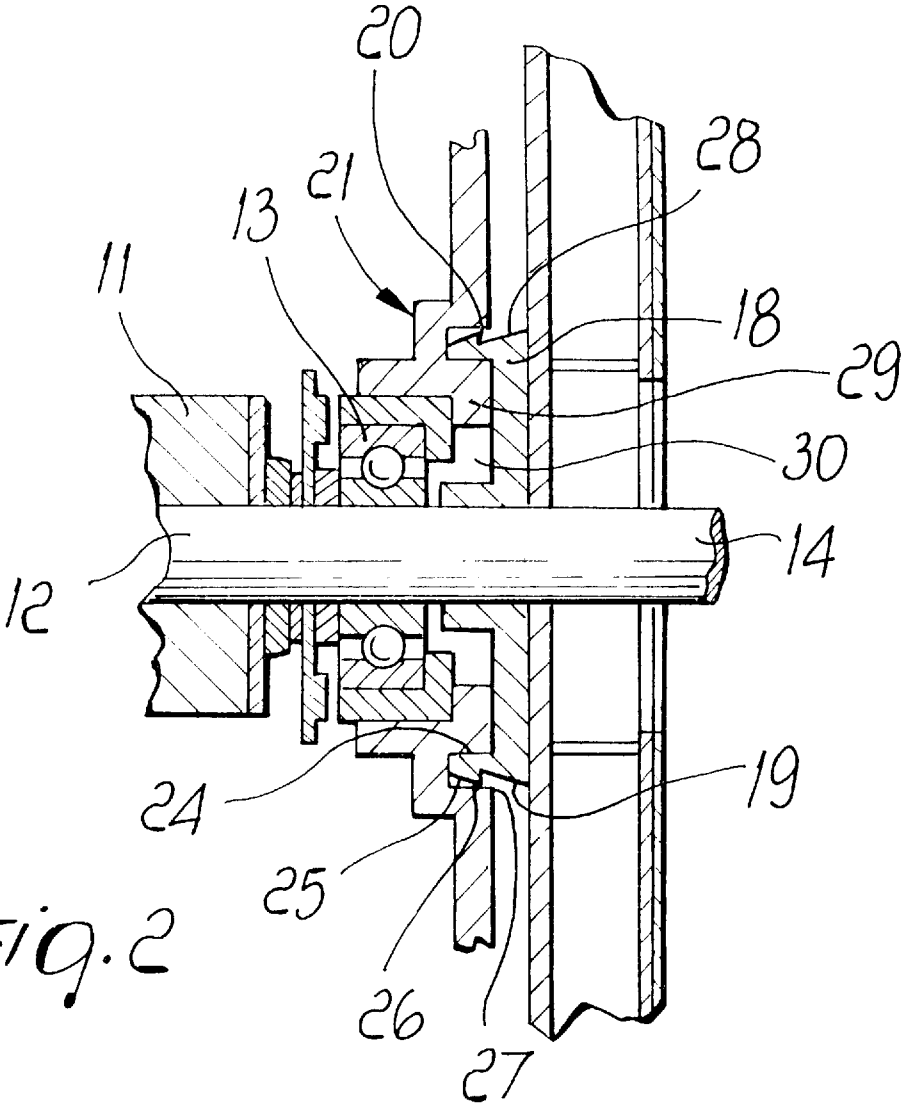
FIG. 2 is a sectional view of a detail of the dust- and liquid-aspirating machine of FIG. 1.

With particular reference to FIGS. 1 to 3, a dust- and liquid-aspirating machine provided with a sealing device according to the present invention, described in greater detailed hereinafter, is generally designated by the reference numeral 10.

The dust- and liquid-aspirating machine 10 comprises an electric motor 11 having a shaft 12 supported by bearings 13; an axial suction impeller 15 is fixed to a cantilevered free end 14 of shaft 12 and is contained in a casing 16 wherein, in this case, a plurality of delivery ducts 17 are formed peripherally and radially.

The sealing device is constituted by an axially perforated disk-shaped element 18 associated with the shaft 12.

Upon assembly, a disk-shaped element 18 is interposed between the electric motor 11 and the casing 16, and its perimetric surface 19 is shaped so as to form two successive tapering portions between which a change in diameter is interposed, forming a step 20.

The configuration of the disk-shaped element 18 is adapted to repel the liquid by centrifugal action and to dissipate its energy in association with the facing surface of a flanged sealing element 21, as better described hereinafter, which has a hollow section 22 encapsulating part of the electric motor 11, and a flange 23 connected to the casing 16 upon assembly.

In this embodiment, the disk-shaped element 18 is shaped so as to form a perimetric ridge 24 affecting a first one of the two tapering portions, designated by the reference numeral 25, which thus cantilevers out with respect to the main plane of arrangement of the disk-shaped element 18.

The first tapering portion 25 is inserted, upon assembly, in an annular slot 26 which is coaxial to the shaft 12 and is formed in the flanged element 21.

Upon assembly, the outer edge 27 forming the slot 26 is nearer to the impeller 15 than the step 20, so as to form a region of high energy dissipation for the liquid.

A second one of the two tapering portions, designated by the reference numeral 28, is arranged, again upon assembly, in the interspace formed by the flanged element 21 of the impeller 15.

An annular projection 29 also protrudes from the flanged element 21; upon assembly, projection 29 is contained, without making contact therewith, in an annular cavity 30 formed in the disk-shaped element 18 on the face directed away from the impeller 15.

The annular projection 29, in association with the surface forming the annular cavity 30, forms a labyrinth path aiming at dissipating the energy of any liquid which may have penetrated beyond the perimetric surface 19.

In practice, it has been observed that the present invention solves the intended aim and objects.

In particular, it should be noted that the combined action of centrifugal repulsion, particularly facilitated by the configuration of the disk-shaped element, and of the convoluted shape of the combined surfaces thereof with the flanged element, provide an effective seal against the penetration of the liquids aspirated by the impeller; it should also be noted that the seal is provided by a device which is substantially simple and in no way hinders the normal operation of the machine.

It should also be noted that the sealing device is absolutely compatible with various dust- and liquid-aspirating machines, including even those which are already commercially available or in production.

It should also be noted that the sealing device according to the present invention allows production with low costs with respect to those for the production of conventional devices.

The present invention is susceptible of numerous modifications and variations, all of which are within the scope of the inventive concept; likewise, the details may be replaced with other technically equivalent elements.

The materials and the dimensions may be any according to requirements.

What is claimed is:

1. A sealing device for dust- and liquid-aspirating machines, comprising an electric motor with a shaft to a cantilevered free end whereof an axial suction impeller is fixed, said impeller being contained in a casing wherein one or more delivery ducts are formed peripherally, said device further comprising an axially perforated disk-shaped element associated with said shaft, interposed between said motor and said casing, and provided with a perimetric surface which is shaped so as to form at least two successive tapering portions between which a change in diameter is interposed and forms a step, the configuration of said disk-shaped element being adapted to repel the liquid by centrifugal action and to dissipate its energy in association with a facing surface of a flanged sealing element having a hollow section that encapsulates part of said electric motor, and a flange connected to said casing upon assembly, said disk-shaped element being shaped so as to form a perimetric ridge affecting at least a first one of, said at least two tapering portions, which cantilevers out with respect to a main plane of arrangement of said disk-shaped element, and said first tapering portion being inserted, upon assembly, in an annular slot which is coaxial to said shaft and is formed in said flanged sealing element.

2. A device according to claim 1, wherein an outer edge forming the slot is nearer, upon assembly, to the impeller than said step, so as to form a region of high energy dissipation for the aspirated liquid.

3. A device according to claim 1, wherein a second one of said at least two tapering portions is arranged, upon assembly, in an interspace formed between said flanged element and said impeller.

4. A device according to claim 1, wherein an annular projection protrudes from said flanged element and is contained in an annular cavity formed in said disk-shaped element on a face which is directed away from said impeller, and said annular projection being arranged in spaced arrangement from and out of contact with said disk-shaped element so as to form a labyrinth path for dissipating energy of any penetrated liquid in the labyrinth path.

* * * * *